US006955633B2

(12) United States Patent
Stout

(10) Patent No.: US 6,955,633 B2
(45) **Date of Patent: *Oct. 18, 2005**

(54) AQUATIC EXERCISE DEVICE

(75) Inventor: Tadlington A. Stout, La Jolla, CA (US)

(73) Assignee: Aqualogix, Inc., San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/657,906

(22) Filed: Sep. 9, 2003

(65) Prior Publication Data

US 2004/0053749 A1 Mar. 18, 2004

Related U.S. Application Data

(63) Continuation of application No. 10/044,552, filed on Jan. 12, 2002, now Pat. No. 6,672,993.
(60) Provisional application No. 60/260,940, filed on Jan. 12, 2001.

(51) Int. Cl.[7] ..... A63B 31/00
(52) U.S. Cl. ..... 482/55; D21/678
(58) Field of Search ..... 482/51, 121–130, 482/132, 140, 142, 146, 148, 147, 44, 49, 55, 56, 108, 111; 446/220; 441/56, 58, 136; D21/678

(56) References Cited

U.S. PATENT DOCUMENTS

| | | | | | |
|---|---|---|---|---|---|
| 3,809,397 | A | * | 5/1974 | Gruenewald | 473/457 |
| 4,468,023 | A | * | 8/1984 | Solloway | 482/10 |
| D344,113 | S | * | 2/1994 | Shelton et al. | D21/678 |
| D352,753 | S | * | 11/1994 | Giannini et al. | D21/678 |

* cited by examiner

*Primary Examiner*—Stephen R. Crow
*Assistant Examiner*—Tam Nguyen

(57) ABSTRACT

An aquatic exercise device providing uniform resistance under water when moved in any direction while concurrently preventing erratic movements which can damage the wrist of the individual using it. The unique design featuring a plurality of orifices in spherical surface minimizes splashing and stirring the water around the user. The device is composed of two or more quadrants having a three sided spherical surface that is ringed by vertical ribs which effectively centralize the forces when moved laterally and work in unison when moved either forward or backward along the central axis. Each quadrant has a plurality of orifices that meter the water passing through the device which can be changed in size to yield an exerciser with more or less resistance. Optional attachable flanges provide for lessening or increasing resistance depending on the diameter of the flange legs and their overhang over the ribs.

19 Claims, 2 Drawing Sheets

AQUATIC EXERCISE DEVICE

RELATED APPLCIATIONS

This application is a continuation of U.S. patent application Ser. No. 10/044,552 entitled AQUATIC EXERCISE DEVICE filed on Jan. 12, 2002 now U.S. Pat. No. 6,672,993 which claims the benefit of U.S. Provisional Application No. 60/260,940 filed Jan. 12, 2001.

BACKGROUND OF THE INVENTION

1. Field of Invention

The present invention relates to an exercise device used by individuals in water. More particularly, it relates to a new and unique hand-held aquatic exercise device which works equally well providing exercise to those inclined to stringent aggressive workout schedules as well as for those who need a gentle form of physical therapy. The device can be used singularly, being used in one hand at a time or in combination where two of the devices are used together and they will come in a variety of sizes.

Where many aquatic exercise devices use flotation as a resistance force, the device herein does not incorporate any means of flotation, thereby allowing that the individuals using it are not exerting themselves by trying to hold it under the water. The device herein provides an equal resistance in any direction during a workout, and is especially beneficial in a boxing style workout, because of the unique shape and the type of resistance in the pushing and pulling motions. A plurality of orifices in the spherical surfaces are designed to maintain a means for controlled release of the resistance pressure upon the device minimizing the stirring and splashing of the water in the individual's face when they are using it. The lightweight simple design also allows that it can be easily fabricated, shipped and stored. Another alternate preferred embodiment of the device provides for the incorporation of an additional resistance member attaching to the fins outer edge.

2. Prior Art

Water oriented exercise devices have been described and disclosed in prior art in various forms which of course yield functions based on their individual form.

U.S. Pat. No. 5,766,116 (Weissbuch) teaches a hand held aquatic exercising device, which includes a handle and relatively moveable hydro-resistive elements at respective ends of the handle. The hydro-resistive elements can be moved to different positions relative to a longitudinal axis through the handle. In another embodiment the hydro-resistive elements are selectively removable from the handle. The hydro-resistive elements can be assembled in different relative positions with the handle. The handle is selectively solid or hollow. The device thereby presents a resistance to the water that can be varied according to the desires of the user. The hydro-resistive elements may be cup-like and may be flexible to facilitate reversal about their bases. A hand-gripping element facilitates rotation of the handle about the longitudinal axis while the gripping element is held in the palm of a user and the device is moved through water. Weissbuch here uses cup-shaped hydro-resistive elements to achieve subsurface resistance for exercising, producing a great deal of stirring and splashing of the water.

U.S. Pat. No. 5,702,331 (Perham) discloses a buoyant body shaped substantially as a short, flexible, columnar buoyant body, constructed from polyethylene expanded foam material having a coloring substance added to produce a colored buoyant body to enhance their use, and to facilitate color coordination with an exerciser's swimwear. The buoyant body includes a port for receiving a hand, or foot, appropriately for the particular device to be used. The port is provided centrally positioned on the buoyant body, and defines a cavity, sized for receiving the exerciser's hand or foot in a relaxed and extended manner, and thus facilitates a non-gripping securement and grip-free manipulation of the buoyant body to produce resistance in a water exercising environment. For a hand manipulated buoyant body, the defined cavity is a rectangular shaped, tapered through-hole that dimensionally conforms to the tapered shape of a hand from fingertips to beyond the knuckles and part of the palm without including the thumb. The fit is snug and relaxed without an exerciser having to exert a gripping force on the buoyant body while manipulating the buoyant body. The feel to the hand during use is a snug, relaxed, and secure feeling, and reflects a compressed deformation of the pliable foam material. The feel to the foot for a corresponding buoyant body is substantially the same.

Perham emphasizes a geometrically shaped buoyant body to provide subsurface resistance, with ports for receiving either a hand or foot. Perham also requires buoyancy of the device for the exercise procedures.

U.S. Pat. No. 5,651,710 (Rives) teaches a swimmer's flexible hand paddle which includes a raised portion centered under a swimmer's hand extending from near a first finger joint to a palm position of the paddle and a flat portion extending from the raised portion out past a outline of a swimmer's hand having thumb, little finger and finger tip offset. The raised portion is substantially straight across a finger edge and tapers of a V-shaped palm edge. The raised portions have shoulders that slope down to the flat portion with the thumb side shoulder forming a thumb rest. A palm piece is also disclosed which is attachable to prior art paddles and provides the raised portion to prior art paddles. Rives however, is directed to a palmed paddle device unlike Applicant's device.

U.S. Pat. No. 5,531,657 (Macedo) discloses an invention wherein a modular aquatic exercise equipment assembly for use by a person in water comprises a gripping bar with water resistance members removably fixed on opposite ends thereof. Each water resistance member comprises a pair of interlocking components having a shaft portion and a planar fin water resistance portion, the two portions having slots for engaging each other so that the components lie substantially flat and when assembled, the two components are interlocked and present a plurality of planar fin water resistance surfaces which extend radially outwardly from the shaft portion.

Macedo essentially protects a modular underwater dumbbell with fin-like water resistant members.

U.S. Pat. No. 5,478,312 (Weissbuch) teaches a hand held aquatic exercising device, which includes a handle and relatively moveable hydro-resistive elements at respective ends of the handle. The hydro-resistive elements can be moved to different positions relative to a longitudinal axis through the handle. In another embodiment the hydro-resistive elements are selectively removable from the handle. The hydro-resistive elements can be assembled in different relative positions with the handle. The handle is selectively solid or hollow. The device thereby presents a resistance to the water that can be varied according to the desires of the user. The hydro-resistive elements may be cup-like and may be flexible to facilitate reversal about their bases. A hand-gripping element facilitates rotation of the handle about the longitudinal axis while the gripping element is held in the palm of a user and the device is moved through water.

Weissbuch thus describes an exercise device, which uses cup-shaped hydro-resistive elements which are bar mounted to achieve subsurface resistance for exercising.

U.S. Pat. No. 5,224,959 (Kasper) discloses a skeleton ball comprising a plurality of loops woven together into a spherical grid derived from polyhedral geometry. The grid's connections are frictionally secured through mutual flexural deformation of loops as a result of the weaving process. The frictionally secured connections allow some embodiments to be collapsed or folded flat through relative sliding motion of loops. Relative sliding motion of loops also allows enlargement of grid openings so the ball may be used as a tote or container. The ball may be designed for buoyancy without need for inflation. The ball is suitable as a swimming or aquatic exercise aid affixed to the limbs through relative sliding of loops. The ball may be fabricated from widely available materials with little capital equipment or material preparation; modification or adaptation of the ball to meet a diverse range of applications is discussed.

Kasper consequently lacks a useable grip and pertains more to the type of woven hoop-like aquatic exercise devices.

U.S. Pat. No. 5,033,739 (MacKechnie) teaches and claims an aquatic exercising device including an elongated handle member having first and second ends having first and second resistance members operatively affixed thereto. The resistance members are connected by flat panels of variable width, which enable resistance to be adapted to the strength and capability of the user. Movement of the aquatic exercising device through a body of water produces a resistance to enhance the exercising capability of an individual utilizing the device. The device may be filled with water through removable caps at each end and used as a gravity weight for exercising. The device may also be emptied of water and used for flotation or buoyancy resistance exercises.

MacKechnie thus requires an elongated handle and has and two funnel shaped members with stationary and moveable vanes for water resistance at the ends. I thus will tend to stir in the water and create substantial twisting from the members at the distal ends.

U.S. Pat. No. 4,988,094 (Beasley) discloses a device, which is used by an exerciser in a body of water. The apparatus comprises an elongated handle forming a handgrip for gripping the apparatus by the hand of the exerciser. A first and a second fluid resistance member is secured at the ends of the elongated handgrip, such that in use when the handgrip is gripped by the hand of the exerciser and moved by the arm of the exerciser in a first plane in which the resistance to such movement is increased. A third fluid resistance member is secured to the handgrip in a plane parallel to the handgrip to form an opening defined by the third fluid resistance members and the handgrip for receiving in use a portion of the hand of the exerciser such that in use when the handgrip is gripped by the hand of the exerciser and moved by the arm of the exerciser in a plane perpendicular to the first plane resistance to such movement is increased. A foot attachment means is secured to the third fluid resistance member for detachably securing the apparatus to a foot of the exerciser such that movement of the apparatus by the leg of the exerciser in a plane perpendicular to the plane which includes the hand gripping means resistance to such movement is increased by the third fluid resistance means and movement of the apparatus by the leg of the exerciser in the plane which includes the hand gripping means is resisted by the first and the second fluid resistance means such that resistance to such movement is increased.

Beasley narrowly claims an underwater exercise device adaptable to both hand and foot use which in using an elongated grip with resistive ends tends to create twisting force in the water during use.

U.S. Pat. No. 4,913,418 (Schlueter) discloses a swimmer's flexible plastic hand paddle, which has a surface area larger than a human hand, and a plurality of perforations (approximating the user's hand size), which are positioned, to an off-set location on the paddle toward the thumb side of the user's hand. The edge of the paddle closely approaches the outer edge of the users hand on the thumb side when the hand is in position on the paddle, whereas on the little finger side of the paddle there is a substantially larger (compared to the thumb side of the paddle) area (preferably unperforated) that makes a water foil. The corners of the paddle are rounded and means for attaching the user's hand to the paddle and positioned it in a desired position over the perforations are provided. The thickness in a plastic material having a modulus of elasticity of about 130,000 p.s.i. is from 2 to 4 mm., preferably 3 mm. Schlueter however, is primarily directed to another palm paddle device U.S. Pat. No. 4,902,005 (McNeill) teaches and claims a water exercise device for use under water including a main body comprised of a lightweight synthetic plastic. The body has a fan-shaped intermediate body section. A pair of tubular sections are provided at opposite margins of the fan-shaped body section. The tubular sections are provided with inner and outer open ends and with the tubular sections being of such diameter for receiving hands and forearms of a person when extended through the inner ends of the tubular sections. Rotary turnable handgrips are disposed in each of said tubular sections generally at the outer ends thereof. The handgrips are held in the tubular sections to limit axial movement of the handgrips while allowing the handgrips to be freely rotated therein when the arms are extended through the inner ends into the tubular section and then into contact with the hand grips. McNeill however requires that it be gripped with two hands and covers the arm area of the user.

The Solloway patent (U.S. Pat. No. 4,819,951) teaches and claims aquatic exercise devices, such as in the form of an aquatic dumbbell, which is provided for interchangeable and comfortable use by men, women and children alike. The aquatic exercise devices permit a large range of movement and increased resistive forces, torque and torsion. The aquatic exercise devices serve as fluid resistors to water flow as the devices are moved through the water. The aquatic dumbbell can have an array of axial fins and outer diverging transverse fins to provide enhanced strength building and hydrodynamic resistance.

However Solloway is a complicated part to manufacture, in that it is composed of many different parts and does not have unique simplicity of the herein disclosed patent. It does not have the variable alignment of the handle with the push or pull axis, and is not well suited for a boxing style of workout.

U.S. Pat. No. 4,784,385 (D'Angelo) describes a variable resistance underwater exercising device for working the muscles of the upper body in a cool environment to stimulate generation of body heat. This requires a support structure, a pair of support arms adjustably mounted on the support structure and a pair of disc assemblies adjustably mounted on the support structure and a pair of disc assemblies adjustably mounted on the support arms. Each of the disc assemblies includes a flat disc, a handle for manually rotating the disc thereby providing exercise to the upper body muscles, a plurality of flat blades carried by the disc and rotatable therewith to provide resistance to rotation in the water, a shroud assembly surrounding the blades and a gearing assembly for collectively varying the angular orientation of the blades with respect to the disc such that resistance of the water against the blades is adjustable to provide the desired drag on the discs as they are manually rotated under water by the user.

However, D'Angelo is a large freestanding underwater device with adjustable blades for controlling the water resistance when blade assemblies are turned by hand and not easily operated nor providing movement by the user.

The McDonald patent (U.S. Pat. No. 4,685,667) describes a series of three separable disk-shaped resistance members having similar openings in the central regions thereof, which, when aligned, permit two or more of the members to be grasped in the hand of the user and moved in unison through the water to exercise the arm of the user. Each resistance member has a face area, which is different from the face area of the other two so the resistance members can be utilized singularly, or in various combinations to adjust the resistance to movement to that desired by the user. The resistance members are made of lightweight, plastic material and the larger members tend to distort when moved through the water by an adult. Reinforcement and prevention of distortion of the larger member is affected by associating one or more of the smaller members with the larger member when it is being used. While this patent is directed to a hand held aquatic exercise device having separable resistance members, it does not allow for lateral resistance nor does it minimize twisting.

The MacKechnie patent (U.S. Pat. No. 4,623,142) claims and discloses an aquatic exercising device including a handle member having a first end and a second end. A first resistance member is operatively affixed to the first end of the handle. A second resistance member is operatively affixed to the second end of the handle. Movement of the aquatic exercising device through a body of water produces a resistance to enhance the exercising capability of an individual utilizing the aquatic exercising device.

Here the claims are directed to an underwater dumbbell and this reference claims funnel shaped supports with vanes.

The Bedgood patent (U.S. Pat. No. 4,565,369) discloses a variable resistance aquatic exercising device provided for subjecting arms, legs and associated parts of a user's body to desired degrees of stress as the user moves his arms or legs through a body of water. The exercising device has a handle and a plurality of flat, elongate panels disposed in stacked relation to each other. Each panel has a mounting aperture through its center. A bolt extends through the apertures and adjustably attaches the panels to the handle. Spacers are positioned between adjacent panels to permit fluid flow between the panels and to protect the surfaces of the panels. The exercising device also has a flexible and adjustable mounting strap, disposed opposite the handle and attached to the panels.

This patent is directed to a variable resistance exercise device adaptable to hand or foot use. The vanes are moveable and it is strapped on using Velcro straps The Solloway patent (U.S. Pat. No. 4,521,011) describes and claims a hydrodynamic stroke builder, which has a specially configured aquatic hand section, and forearm section with fins to progressively strengthen a person's arms, shoulders, chest and back. The hydrodynamic stroke builder can be interchangeably used by men, women and children alike and permits a wide range of movement with controlled amounts of fluid resistive forces, torque and torsion underwater. The stroke building consists of a hand engaging section which is either flat or convex and which has holes therein so that the user's fingers can readily grasp the hand engaging section. The forearm section conforms to the shape of the user's forearm and has V or U shaped fins extending therefrom to provide the proper resistance when the device is being used. The stroke builder can also include an upper arm section similar in design to the forearm section. The various sections are connected together by way of hinges.

This earlier Solloway patent aims to increase water resistance for arm and leg exercise as well as for baseball, golf and tennis swings.

The Beasley patent (U.S. Pat. No. 4,509,744) teaches an aquatic exercise device for use in a swimming pool or the like comprising a substantially rectangular, flat rigid fluid resistance member having an adjustable substantially U-shaped hand gripping member disposed in fixed spaced relation relative to the surface of the substantially rectangular flat rigid fluid resistance member by a pair of substantially parallel interconnecting members and a wrist guide including a flat rigid stability member extending in a coplanar relation relative to the substantially rectangular flat rigid fluid resistance member to engage the user's wrist and a substantially J-shaped axial alignment member extending from one longitudinal edge of flat rigid stability member to receive the user's wrist such that the user grasps the adjustable substantially U-shaped hand gripping member while placing his wrist within the substantially J-shaped axial alignment member, whereby the user moves the aquatic exercise device through the water to create a significant resistance on the substantially rectangular flat rigid fluid resistance member to exercise the user.

This patent is directed to basically a hand paddle-type device with a wrist guide and resistant planar surface. The Yacoboski patent (U.S. Pat. No. 4,480,829) describes an exercising and body-toning device for use by a person in water comprising a handle with circular resistance members fixed on opposite ends thereof. Each resistance member comprises a pair of coaxal discs with sector openings therethrough so that they may be fixed in selected relative angular positions, with the openings in adjusted registration to adjust the resistance of movement of the device through water.

This patent is directed to a simple hand held aquatic exerciser with variable resistance capabilities using rotatable discs.

A majority of the foregoing patents of interest describe unique methods or devices directed at aquatic exercise devices. However, none of these systems or apparatuses provides the ease of use and adjustment as well as the stable travel through the water of the device herein disclosed and described.

SUMMARY OF THE INVENTION

The present invention accomplishes its desired objects by providing the Aquatic exerciser as a truly unique and versatile aquatic exercise device. This new device in a preferred embodiment will consist of a unitary spherical unit divided into two or more quadrants by fins that are substantially perpendicular to the tangent of the spherical surface. When used the device is held in the hand of the individual by the means of a handgrip and moved through the water. The handgrip may be in the shape of a pistol grip or a straight rod that is located within the inner spherical chamber formed by the outer quadrants.

Each quadrant is comprised of three fin-surfaces, two parallel to the central axis of the unit and one transverse to the central axis, all at equal angles and perpendicular to a tangent line on the spherical surface. The spherical surface of each quadrant has a plurality of orifices that provide a means to adjust the force and to stabilize the device as it moves through the water, and to minimize splashing and stirring of the water. These orifices in the spherical surfaces provide this means to adjust the force required to move the device through water by providing the metering of the water flowing through the device which concurrently helps control the stability. These orifices also allow the device to drain when removed from the water along with insuring that air is not entrapped within the inner spherical chamber when in use.

The device in the current preferred embodiment will be available with different sizes of orifices and fins, for varying degrees of resistance in the water, without deviating from the scope of the patent. In this fashion, the device could be provided in a singular fashion with one size orifice and fins or as a kit with differing sized orifices and fins combining to yield different resistance when forced through the water. Without the plurality of orifices in the spherical surfaces, the device would be unstable making erratic movements and tend to go to the line of least resistance or the weakest angle of pressure on a persons wrist. This uncertain erratic action can seriously damage the wrist of the individual using this or any other device. Thus, the orifices provide a means to stabilize the device during movement through the water.

All of the three fin surfaces are angled similarly with relation to the spherical surface as a means of concentrating the resistive force on the axis of each quadrant when moved in a lateral direction. When the device is pushed parallel to the central axis, the quadrants work in combination for a balanced means of resistance thereby minimizing twisting and providing a smooth flow of the device when used. With the inherent angle of the joined transverse fin surfaces of the quadrants, forming the back periphery of the device, a funnel is created as a means to channel the water into the inner spherical chamber to be metered out through the plurality of orifices when the device is pulled through the water. This unique and very inventive channeling of forces along varying axes, coupled with metering the passage of water through the device, creates an extremely stable, yet light weight aquatic exercise device.

An alternate preferred embodiment of the aquatic exerciser will have each quadrant as a separate identical piece, to be attached together by any one of a number of conventional means of attachment including one or a combination of snapping together, glue or fasteners. By making the quadrants as separate substantially identical pieces, a great deal can be saved in molding costs. Also, savings will be made in shipping the unit disassembled in a smaller box to be assembled by the individual purchasing the device. The handgrip will be inserted at assembly by a means of attachment such a threaded rod, a nut and washer at each end, cooperative frictional engagement or similar means of attachment. With this unique method of mounting of the handgrip through a plurality of mounting holes, the angle of the handgrip within the inner spherical chamber can be adjusted for the comfort of the individual using the device. This unique method of assembly does not deviate from the intended scope of the patent on the herein disclosed aquatic exerciser device in any way.

An additional preferred embodiment of the aquatic exerciser device will have a mountable flange member configured for registered engagement with the ribs on the assembled unit and mounted to the device with a central alignment member using a means of attachment such as conventional fasteners on the ends of each flange member. This flange member will increase the resistive force in each quadrant of the device by trapping the water against the outer spherical surface and thereby provide a means of adjustment of forward and rearward resistive force. As can be seen, a kit of the flanges could be provided in various sizes to provide further means to adjust the forward and rearward resistive force.

An object of this invention is to create a device that works equally well for an aggressive workout as it does for physical therapy.

Another object of this invention is to create a device that has equal and uniform resistance in any direction that it is thrust.

An additional object of this invention is to create a device that is stable when it is thrust in any direction, not making erratic movements, trying to seek the path of least resistance. Another object of this invention is to create a device that has a cushion to the resistance, by metering the passage of the water through the device.

Still another object of this invention is to create a device that is lightweight and can be easily shipped or stored.

A still further object of the invention is to create a device that does not create a great deal of splashing in the face of the individual using it.

These together with other objects and advantages will become subsequently apparent reside in the details of the construction and operation as more fully hereinafter described and claimed, reference being had to the accompanying drawings forming a part hereof, wherein like numerals refer to like parts throughout.

BRIEF DESCRIPTION OF THE DRAWING FIGURES

The accompanying drawings, which are incorporated in and form a part of this specification, illustrate embodiments of the invention and together with the description, serve to explain the principles of the invention.

DETAILED DESCRIPTION OF THE PREFERRED EMBODIMENTS

Figure 1:
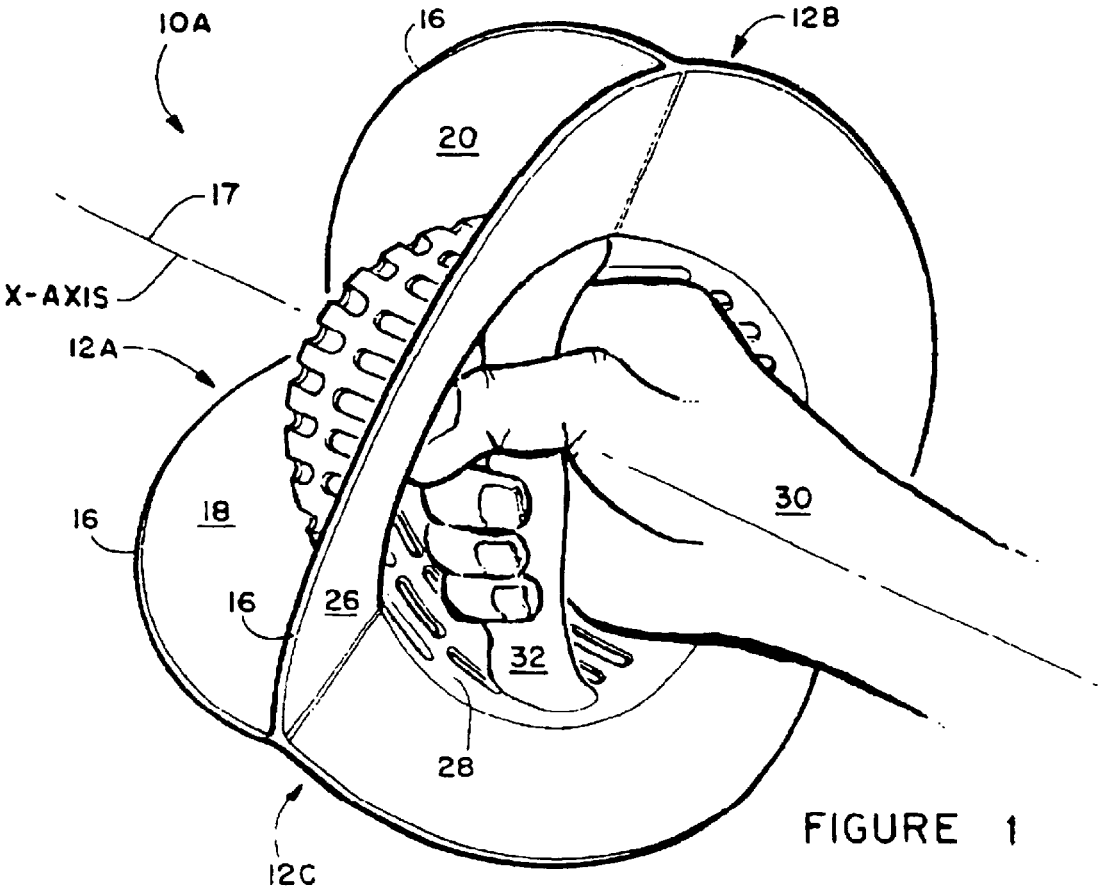
FIG. 1 depicts a perspective view of the aquatic exerciser device from the rear with an individual user's hand holding the handgrip attached to the interior surface of the bell.
Figure 2:
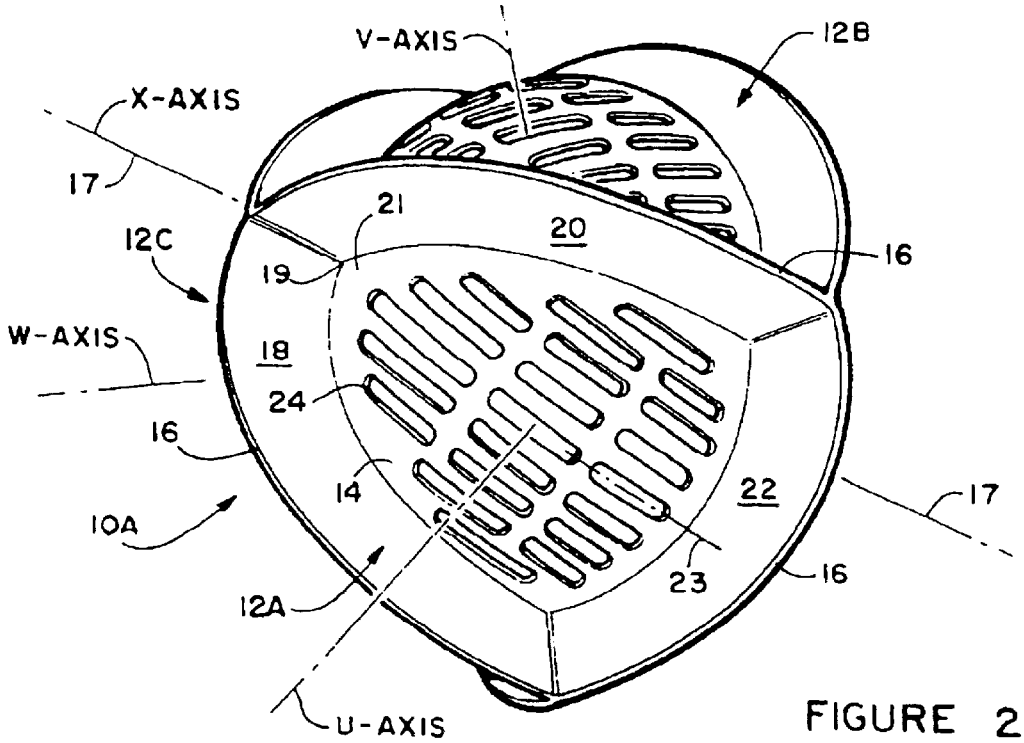
FIG. 2 depicts a perspective view of the aquatic exerciser.

FIG. 1 is an illustration of a perspective view from the backside of a bell device 10A. The device 10A is shown in it's preferred embodiment of three quadrants, 12A, 12B and 12C, although it must be understood that it can be constructed in any number of quadrants, from two or more without deviating from the scope of this patent. Quadrant 12A, being a typical quadrant illustrated in FIG. 2, consists of an outer spherical surface 14 enclosed by three fins 16 all perpendicular to a tangent line on spherical surface 14. These fins 16 may vary in size on different units and still be within the scope of the patent. Two of the fins 16 on the device 10A are parallel to the central axis or X-axis with fin surfaces 18 and 20 facing inwardly into quadrant 12A and with one fin 16 transverse to the X-axis with fin surface 22 facing inwardly, all fin surfaces 18, 20 and 22 at equal angles to the spherical surface 14. Each quadrant 12A, 12B and 12C will have a line of axial force as represented by U-axis, V-axis and W-axis. When the device 10A is laterally thrust through the water, the angle of the fins 16 results in a pressure on the three fin surfaces 18–22 directed along the U,V, and W axes. When the device 10A is thrust forward, parallel to the central axis or X-axis, the quadrants 12A, 12B and 12C work in combination to produce a balanced means of resistance and thereby minimize twisting force.

The spherical surface 14 of each quadrant 12A has a plurality of orifices 24 that are used to cushion the force and stabilize the aquatic exercise device 10A as it moves through the water. The sizes and shapes of the orifices 24 may vary with different units and still be within the scope of the patent. In the current best mode the orifices 24 are elongated along a central axis 23 through each of the orifices 24. Each orifice central axis 23 points toward an axis point 19 on the exterior surface 21 of the bell, where the axis point 19 is formed at the intersection of the x axis 17 and the exterior surface 21. Water vents through the arrangement of orifices 24 to stabilize the device 10 during use and minimize twisting when the device 10 is moved back and forth along the x axis 17 underwater by the user. With each such orifice central axis 23 pointing toward the axis point 19 on the exterior surface 21 of the bell formed by the device 10 where the x axis 17 intersects the exterior surface 21, a means to stabilize the device 10 during use is provided by venting the water through the orifices 24 in a directional fashion which minimizes twisting when the device 10 is moved back and forth along the x axis 17 underwater by the user.

The inherent angle of the transverse fin surface 22 of fin 16, with the back side 26, is used in combination with those of the other quadrants 12B and 12C, forming the back periphery of the device 10, thus creating a funnel as a means to channel the water into the inner spherical chamber 28 to be metered out through the plurality of orifices 24 in the spherical surface 14 for means of resistance, when the device is pulled back through the water. Of course changing the size of the orifices 24 provides a means of adjustment of the resistance provided when the device is pushed or pulled through the water so providing devices 10 with different sized orifices 24 in a kit form would allow the user to adjust the resistance to a desired level by choosing the device 10 with the appropriate sized orifices.

When used, the aquatic exercise device 10A is held in the hand 30 of the individual by the means of handgrip 32. The handgrip 32 may be in the shape of a pistol grip or a straight rod that is located within the inner spherical chamber 28 formed by the quadrants 12A, 12B and 12C.

Figure 3:
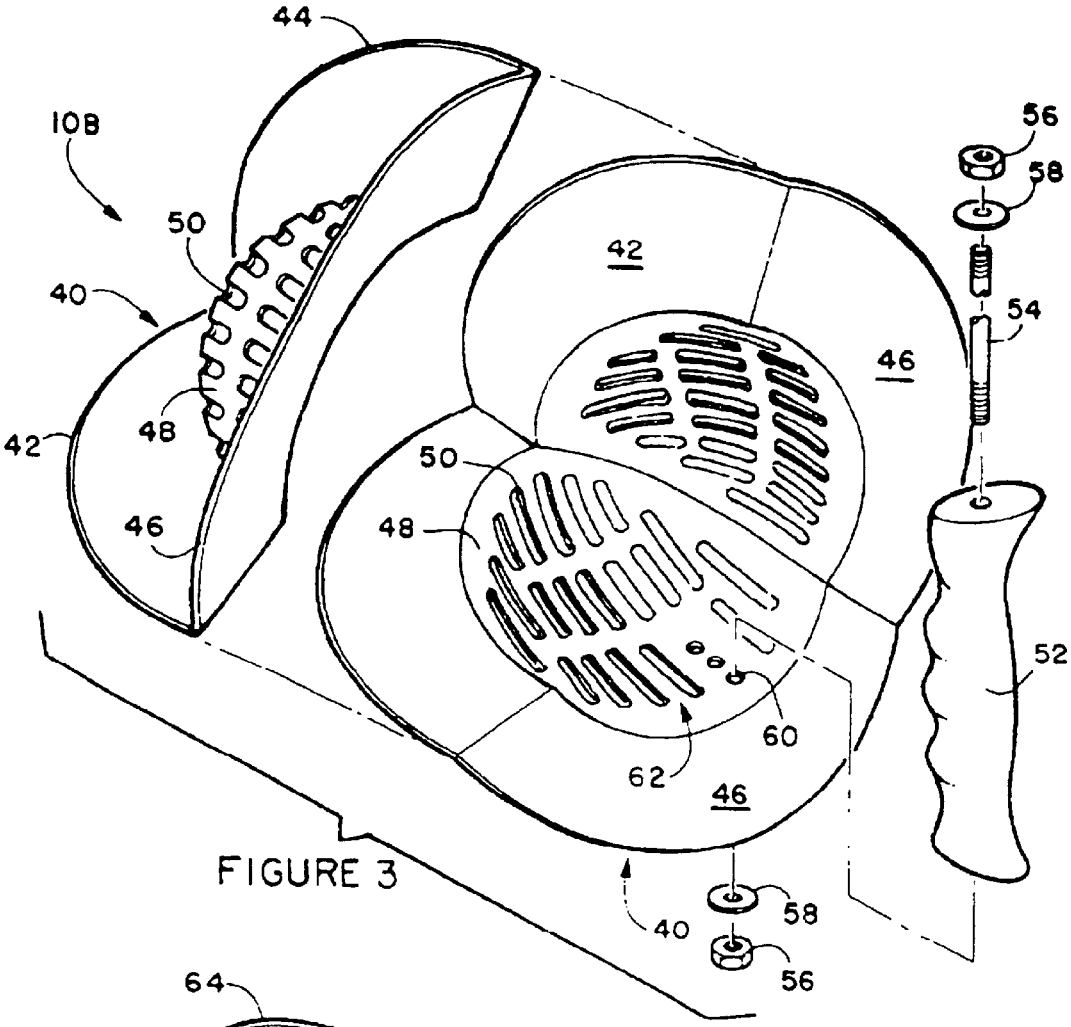
FIG. 3 depicts a perspective exploded view of the device with the bell formed with each quadrant being a separate piece, showing one quadrant removed with the handle and mounting hardware.
Figure 4:
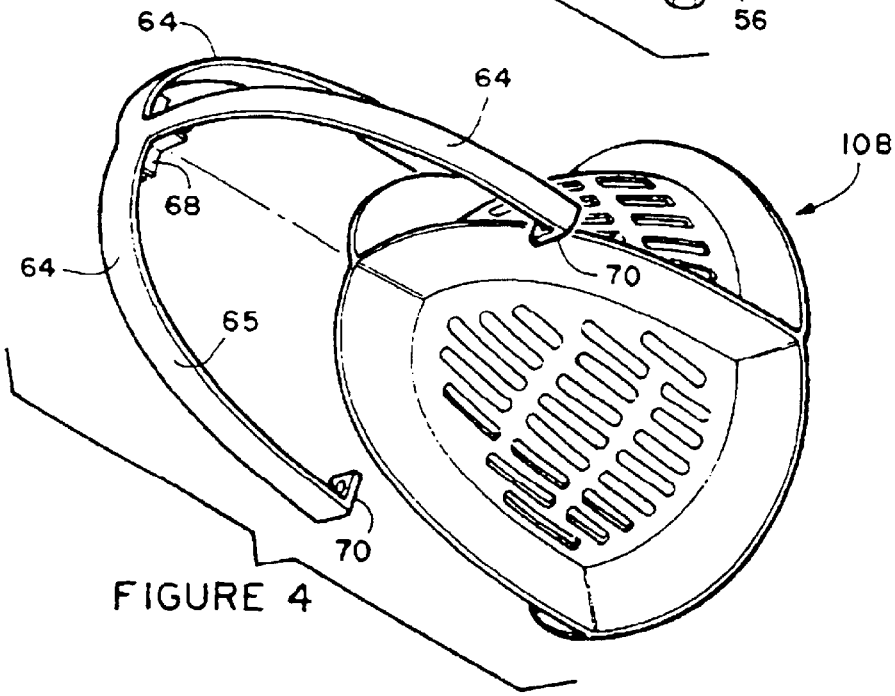
FIG. 4 is an illustration of a perspective view of an exemplary aquatic exercise device having a flange member.

An alternate embodiment illustrated in FIG. 3, of the aquatic exercise device 10B having quadrants 40 as separate identical pieces, to be attached together by any one of a number of conventional attachment means, as in snapping together, glue or fasteners. Each quadrant 40 will be comprised of three separate fins 42, 44 and 46 with a spherical surface 48 having a plurality of orifices 50. The handgrip 52 will be removably attached means of attachment to one of a plurality of attachment points as depicted with threaded rod 54, nut 56 and washer 58 at each end of the rod 54. With this unique method of mounting of the handgrip through a plurality of mounting holes 60, the angle of the handgrip within the inner spherical chamber 62 can be adjusted for the comfort of the individual using the device.

Another alternate embodiment of the aquatic device 10A and 10B will have a flange member 64 configured to match the number of fins 16 on the assembled unit and mounted to the device with a central alignment member 68 and means of attachment such as conventional fasteners on the ends of each flange member 70. This embodiment provides a means to vary the forward and rearward resistance of the device when moved through water. When attached the flange member 64 would impart more resistance and the flange 64 when provided in kit form featuring a plurality of flange members 64 with varied sized diameters 65 which would overhang the ribs 16 and thereby provide variable resistance depending on the diameter.

Therefore, the aquatic exercise device 10, includes at least a plurality of fins 16 arranged to form a bell and handgrip 32 (handle) connected within the bell. The plurality of fins include at least one transverse fin 16 that at least partially encircles the inner cavity 28 of the bell and a plurality of longitudinal fins 16 extending from the axis point 19 (apex) to the transverse fin 16 having a transverse fin surface 22. The bell may also have a spherical surface 14 positioned between the longitudinal fins 16, where the spherical surface 14 includes several orifices (apertures) 24 allowing water to vent into or from the inner cavity when the device is moved through water. By symmetrically arranging and sizing the fins 16 and apertures 24, a resistance can be produced when the device 10 is moved through water where the resistance is independent to the direction the device 10 is moved in a plane tangential to the axis point 19 (apex).

While the present invention has been described herein with reference to particular embodiments thereof, a latitude of modification, various changes and substitutions are intended in the foregoing disclosure, and it will be appreciated that in some instance some features of the invention will be employed without a corresponding use of other features without departing from the scope of the invention as set forth.

I claim:

1. An aquatic exercise device comprising:

a bell having a solid outer surface and a plurality of apertures through the outer surface adapted to allow water when the device is moved through water;

a plurality of fins extending from the outer surface of the bell; and a handle connected within an interior of the bell and accessible by a human hand through an opening in the bell.

2. An aquatic exercise device in accordance with claim 1, wherein at least a portion of the plurality of fins are arranged symmetrically along the outer surface of the bell.

3. An aquatic exercise device in accordance with claim 1, wherein the plurality of fins comprise:

a plurality of longitudinal fins; at least one curved transverse fin at least partially encircling an inner cavity of the bell; the plurality of longitudinal fins extending from an apex of the bell to the at least one curved transverse fin.

4. An aquatic exercise device in accordance with claim 3, wherein the plurality of longitudinal fins are symmetrically arranged.

5. An aquatic exercise device in accordance with claim 3, wherein the plurality of apertures have an elongated shape.

6. An aquatic exercise device in accordance with claim 5, wherein the plurality of apertures are arranged in rows along axes extending from the apex to the transverse fin.

7. An aquatic exercise device in accordance with claim 3, wherein the plurality of longitudinal fins extend perpendicular to the surface of the bell.

8. An aquatic exercise device in accordance with claim 3, wherein the plurality of fins and the apertures are arranged to provide a resistance independent of a direction of motion within a transverse plane tangential to the apex of the bell.

9. An aquatic exercise device in accordance with claim 3, further comprising:

a flange member attached at least to the apex and forming a plurality of flanges along the longitudinal fins.

10. An aquatic exercise device in accordance with claim 9, wherein the plurality of flanges are perpendicular to the longitudinal fins.

11. An aquatic exercise device comprising:

a bell comprising:

a plurality of curved longitudinal fins; at least one curved transverse fin at least partially encircling an inner cavity of the bell, the plurality of curved longitudinal fins extending from an apex of the bell to the at least one curved transverse fin; and a handle connected within the bell and accessible by a human hand through an opening of the bell.

12. An aquatic exercise device in accordance with claim 11, wherein the at least one curved transverse fin and the plurality of curved longitudinal fins are arranged to provide a resistance independent of motion through water with in a transverse plane tangential to the apex of the bell.

13. An aquatic exercise device in accordance with claim 12, wherein the plurality of longitudinal fins are symmetrically arranged.

14. An aquatic exercise device in accordance with claim 11, wherein the bell further comprises a section of spherical surface between each of the longitudinal fins, the section of spherical surface having a plurality of apertures for allowing water to vent when the aquatic exercise device is moved through water.

15. An aquatic exercise device in accordance with claim 14, wherein the plurality of apertures are arranged in rows along axes extending from the apex to the transverse fin.

16. An aquatic exercise device in accordance with claim 14, wherein the plurality of fins and the plurality of apertures are arranged to provide a resistance independent of a direction of motion within a transverse plane tangential to the apex of the bell.

17. An aquatic exercise device in accordance with claim 16, wherein the plurality of apertures have a size to provide a resistance independent of the direction of motion within the transverse plane tangential to the apex of the bell.

18. An aquatic exercise device in accordance with claim 11, further comprising:

a flange member attached at least to the apex and forming a plurality of flanges along the longitudinal fins.

19. A method of aquatic exercise comprising: holding a handle of an aquatic exercise device comprising a bell having a plurality of curved longitudinal fins, at least one curved transverse fin at least partially encircling an inner cavity of the bell, the plurality of curved longitudinal fins extending from an apex of the bell to the at least one curved transverse fin, and the handle connected within the bell; and moving the aquatic exercise device through water to achieve a resistance independent to a direction of motion within a transverse plane tangential to an apex of the bell.

* * * * *

UNITED STATES PATENT AND TRADEMARK OFFICE

CERTIFICATE OF CORRECTION

PATENT NO. : 6,955,633 B2
DATED : October 18, 2005
INVENTOR(S) : A. Stout

It is certified that error appears in the above-identified patent and that said Letters Patent is hereby corrected as shown below:

Column 9,
Lines 28-35, cancel "With each such orifice central axis 23 pointing toward the axis point 19 on the exterior surface 21 of the bell formed by the device 10 where the x axis 17 intersects the exterior surface 21, means to stabilize the device 10 during use is provided by venting the water through the orifices 24 in a directional fashion which minimizes twisting when the device 10 is moved back and forth along the x axis 17 underwater by the user.".

Column 10,
Line 41, insert -- flow -- before "when".

Signed and Sealed this

Twenty-first Day of March, 2006

JON W. DUDAS
*Director of the United States Patent and Trademark Office*